United States Patent [19]

Andrews

[11] Patent Number: 4,793,078

[45] Date of Patent: Dec. 27, 1988

[54] INSOLES FOR FOOTWEAR

[76] Inventor: Anthony C. Andrews, 299 Muswell Hill Broadway, London, N.10., England

[21] Appl. No.: 41,718

[22] Filed: Apr. 23, 1987

[30] Foreign Application Priority Data

Apr. 24, 1986 [GB] United Kingdom ..... 8609998

[51] Int. Cl.[4] ..... A43B 13/38

[52] U.S. Cl. ..... 36/43; 36/44

[58] Field of Search ..... 36/31, 43, 44, 71

[56] References Cited

U.S. PATENT DOCUMENTS

| | | | |
|---|---|---|---|
| 2,200,849 | 5/1940 | Margolin | 36/44 X |
| 2,917,844 | 12/1959 | Scholl | 36/44 X |
| 2,928,193 | 3/1960 | Kristan | 36/44 X |
| 4,633,877 | 6/1987 | Pendergast et al. | 36/44 X |
| 4,674,204 | 6/1987 | Sullivan et al. | 36/44 |
| 4,674,205 | 6/1987 | Anger | 36/44 |

FOREIGN PATENT DOCUMENTS 2124473 2/1984 United Kingdom .

*Primary Examiner*—Donald Watkins

*Attorney, Agent, or Firm*—Rosen, Dainow, & Jacobs

[57] ABSTRACT

An insole for footwear which includes a layer (11) of resilient plastics material shaped so as to provide support for the metatarsal region (at 14) or the valgus region (at 16) of the foot, or both, and having a covering 12 of cloth or other suitable material secured to its upper surface, wherein the upper surface of the plastics material has a number of depressions (18 and 18*a*) in each of which can be fitted an insert (19 or 19*a*) so that the user can adapt the insole to suit his or her particular foot condition by omitting an insert (19 or 19*a*) from any depression (18 or 18*a*) which corresponds to the position of a sensitive spot on the user's foot.

11 Claims, 1 Drawing Sheet

INSOLES FOR FOOTWEAR

BACKGROUND OF THE INVENTION

This invention relates to insoles, sometimes called "socks" which are in the form of a resilient pad intended to be inserted in footwear and shaped for the purpose of of providing support for the wearer's metatarsal arch or valgus region of the foot, or both.

OBJECT AND SUMMARY OF THE INVENTION

Often the wearer may have sensitive areas or regions on his foot where it is undesirable that pressure should be transmitted from the footwear via the insole, and it is an object of the present invention to provide an improved insole which the user may readily and easily adapt to his individual needs.

The present invention consists in an insole for footwear which includes a layer of resilient plastics material shaped so as to provide support for the metatarsal region or the valgus region of the foot, or both, and having a covering of cloth or other suitable material secured to its upper surface, wherein the upper surface of the plastics material has a number of depressions in each of which can be fitted an insert so that the user can adapt the insole to suit his or her particular foot condition by omitting an insert from any depression which corresponds to the position of a sensitive spot on the user's foot.

Preferably, each insert is composed of resilient plastics material having an adhesive under surface to retain it in position in its depression and may have an upper covering corresponding to that the insole. In the accompanying drawings:

DESCRIPTION OF THE PREFERRED EMBODIMENTS

Figure 1:
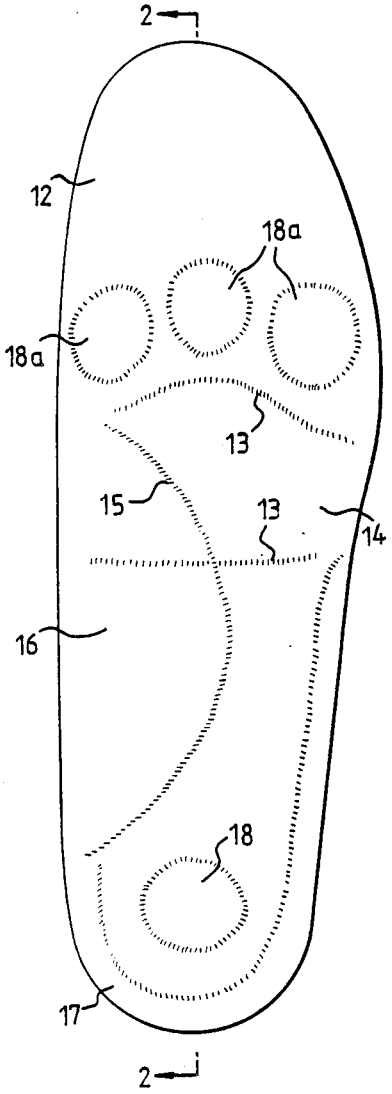
FIG. 1 is a plan view of one form of insole according to the present invention.
Figure 2:
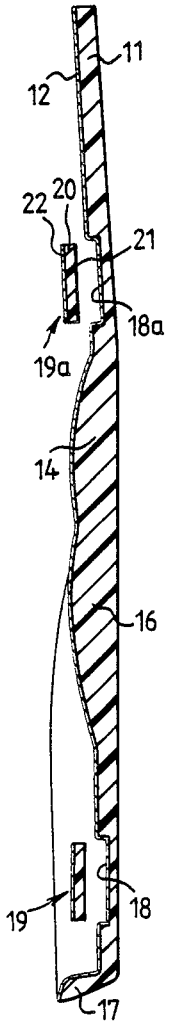
FIG. 2 is a longitudinal section taken on line 2—2 of FIG. 1.
Figure 3:
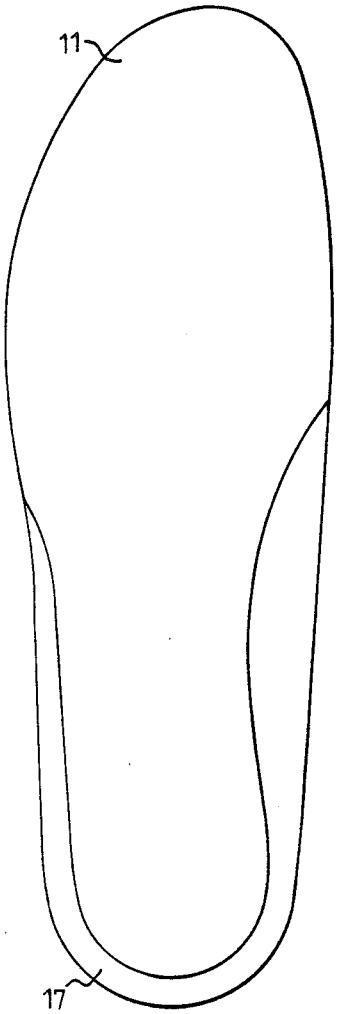
FIG. 3 is an underneath view of the insole of FIG. 1.

In carrying the invention into effect according to one convenient mode by way of example, FIGS. 1, 2 and 3 show an insole consisting of a relatively thin (say 3 mm) moulded layer 11 of resilient plastics material, such as plastozote (foamed, cross-linked polyethylene), covered with an upper layer of cloth 12 bonded to it during the moulding process.

The thickness of the layer 11 is increased between lines 13 to provide a metatarsal arch support 14 and within the arc 15 to provide valgus support 16. The moulding is also provided with an upturned flange portion 17 around the heel region.

As will be seen from FIG. 1, the layer 11 is formed with a depression 18 in the region of the heel and three depressions **18*a* in front of the arch support 14. As depicted in FIG. 2, cloth covering 12 extends into depressions 18, 18*a*** essentially leaving the entire respective depression exposed.

Any of these depressions 18 or **18*a* in the layer 11 may be filled by inserts 19 and 19*a* consisting of resilient plastics material 20 having an adhesive under surface 21 to retain it in position in the depression 18 and an upper cloth covering 22. When preparing the insole for use, the inserts 19 and 19*a* will normally be fitted into some of the depressions 18 and 18*a* but will be omitted from other depressions as required to suit the user's needs for his particular foot conditions, so that over the areas of the depressions 18 and/or 18*a*** without inserts pressure will not be transmitted to a sensitive spot or spots under the user's foot from his footwear.

Obviously, the number, shape and position of the depressions 18 and **18*a*** may be chosen as best suited to the needs of most users.

Figure 4:
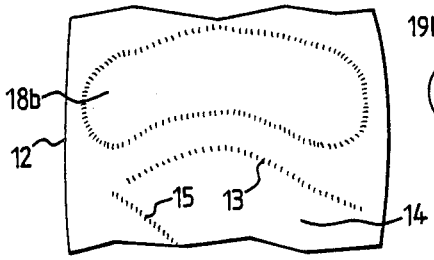
FIG. 4 is part of a plan view showing a modification to the insole of FIGS. 1 to 3.
Figure 4:
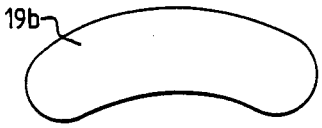

Preferably, as depicted in FIGS. 1, 2 and 4, each depression 18, **18*a*, 18*b* has a periphery extending entirely within layer 11, i.e., bounded entirely by layer 11**, which periphery is smoothly contoured throughout.

In a modification shown in FIG. 4, the three depressions **18*a* in front of the arch support 14 are replaced by a single elongated depression 18*b* which is generally banana-shaped for receiving a correspondingly shaped insert 19*b*. Portions may be cut from this insert 19*b***, or it may be cut into pieces to suit the user's requirements.

Various modifications may be made within the scope of the present invention.

I claim:

1. An insole for footwear, comprising:

a layer of resilient plastic material including integral therewith a portion shaped and positioned to provide support for at least one of the metatarsal and valgus regions of a foot;

a covering secured to said upper surface of said layer;

said layer having a plurality of depressions therein and said insole including a plurality of inserts corresponding in number to said plurality of depressions, said depressions and said inserts being sized and shaped such that a corresponding insert may be releasably fitted in a corresponding depression, said depressions being configured and positioned such that upon selective removal of a respective insert or inserts a respective depression or depressions is exposed corresponding to a sensitive spot or spots on a user's foot.

2. An insole as claimed in claim 1, wherein each insert is composed of resilient plastics material having a releasable adhesive under surface to retain it in position in its depression.

3. An insole as claimed in claim 1, wherein a depression is provided in the region of the heel.

4. An insole as claimed in claim 1, 2 or 3, wherein two or more depressions are provided in front of the metatarsal region.

5. An insole as claimed in claim 1, 2 or 3, wherein a single elongated depression is provided in front of the metatarsal.

6. An insole as claimed in claim 1, wherein said covering is secured to said layer such that said covering extends into said depressions leaving said depressions exposed, and said inserts are releasably fitted into said depressions over said covering.

7. An insole as claimed in claim 1, wherein said covering is made of a cloth.

8. An insole as claimed in claim 1, wherein each of said depressions has a periphery extending entirely within said layer.

9. An insole as claimed in claim 1, wherein each of said depressions has a smoothly contoured periphery.

10. An insole as claimed in claim 1, wherein a plurality of said depressions are provided adjacently disposed and forward of an arch support area.

11. An insole for footwear, comprising:

a layer of resilient plastic material including integral therewith a portion shaped and positioned to provide support for at least one of the metatarsal and valgus regions of a foot;

a covering secured to said upper surface of said layer;

said layer having a plurality of depressions therein and said insole including a plurality of inserts corresponding in number to said plurality of depressions, at least two of said depressions being located forward of an arch support area of said insole, said depressions and said inserts being sized and shaped such that a corresponding insert may be releasably fitted in a corresponding depression, said depressions being configured and positioned such that upon selective removal of a respective insert or inserts a respective depression or depressions is exposed corresponding to a sensitive spot or spots on a user's foot.

* * * * *